US009466928B2

(12) United States Patent
Luettermann

(10) Patent No.: US 9,466,928 B2
(45) Date of Patent: Oct. 11, 2016

(54) PLUG-IN CONNECTOR

(75) Inventor: Dieter Luettermann, Rahden (DE)

(73) Assignee: HARTING ELECTRONICS GMBH, Espelkamp (DE)

( * ) Notice: Subject to any disclaimer, the term of this patent is extended or adjusted under 35 U.S.C. 154(b) by 0 days.

(21) Appl. No.: 14/351,521

(22) PCT Filed: Sep. 7, 2012

(86) PCT No.: PCT/DE2012/100273

§ 371 (c)(1),
(2), (4) Date: Apr. 11, 2014

(87) PCT Pub. No.: WO2013/056696

PCT Pub. Date: Apr. 25, 2013

(65) Prior Publication Data

US 2014/0302714 A1 Oct. 9, 2014

(30) Foreign Application Priority Data

Oct. 18, 2011 (DE) ..... 10 2011 054 563

(51) Int. Cl.
*H01R 9/03* (2006.01)
*H01R 24/20* (2011.01)
(Continued)

(52) U.S. Cl.
CPC ..... *H01R 24/20* (2013.01); *H01R 13/514* (2013.01); *H01R 13/6581* (2013.01); *H01R 13/516* (2013.01); *H01R 13/6592* (2013.01)

(58) Field of Classification Search
CPC ..... H01R 13/62938; H01R 13/633; H01R 13/62933; H01R 13/658; H01R 13/514
USPC ..... 439/157, 160, 372, 607.55, 701
See application file for complete search history.

(56) References Cited

U.S. PATENT DOCUMENTS 4,840,574 A * 6/1989 Mills ..... B23K 9/323 439/157
5,273,459 A * 12/1993 Davis ..... H01R 13/65802 439/607.48

(Continued)

FOREIGN PATENT DOCUMENTS

CN 1093496 A 10/1994
CN 201868679 U 6/2011

(Continued)

OTHER PUBLICATIONS

International Preliminary Report on Patentability issued in corresponding application No. PCT/DE2012/100273, dated Apr. 24, 2014 (6 pgs).

(Continued)

*Primary Examiner* — Thanh Tam Le
(74) *Attorney, Agent, or Firm* — Hayes Soloway, P.C.

(57) ABSTRACT

To minimize the assembly effort of a plug-in connector the plug-in connector has multiple parts in the form of assembled individual parts. The shielding device has first guide in operative connection with a second guide of the contact support, so that the contact support can be inserted into the insulating body or can be attached thereto by a pivoting movement of the shielding device. After manually inserting the contacts into the contact support, the shielding device can be pivoted via the insulating body with a single movement, as a result of which the contact support is inserted into the insulating body, whereby the contacts are finally fixed in the insulating body, the shielding device is latched onto the contact support and as a result the contact support can be fixed in or on the insulating body.

14 Claims, 13 Drawing Sheets

Figure 1A:
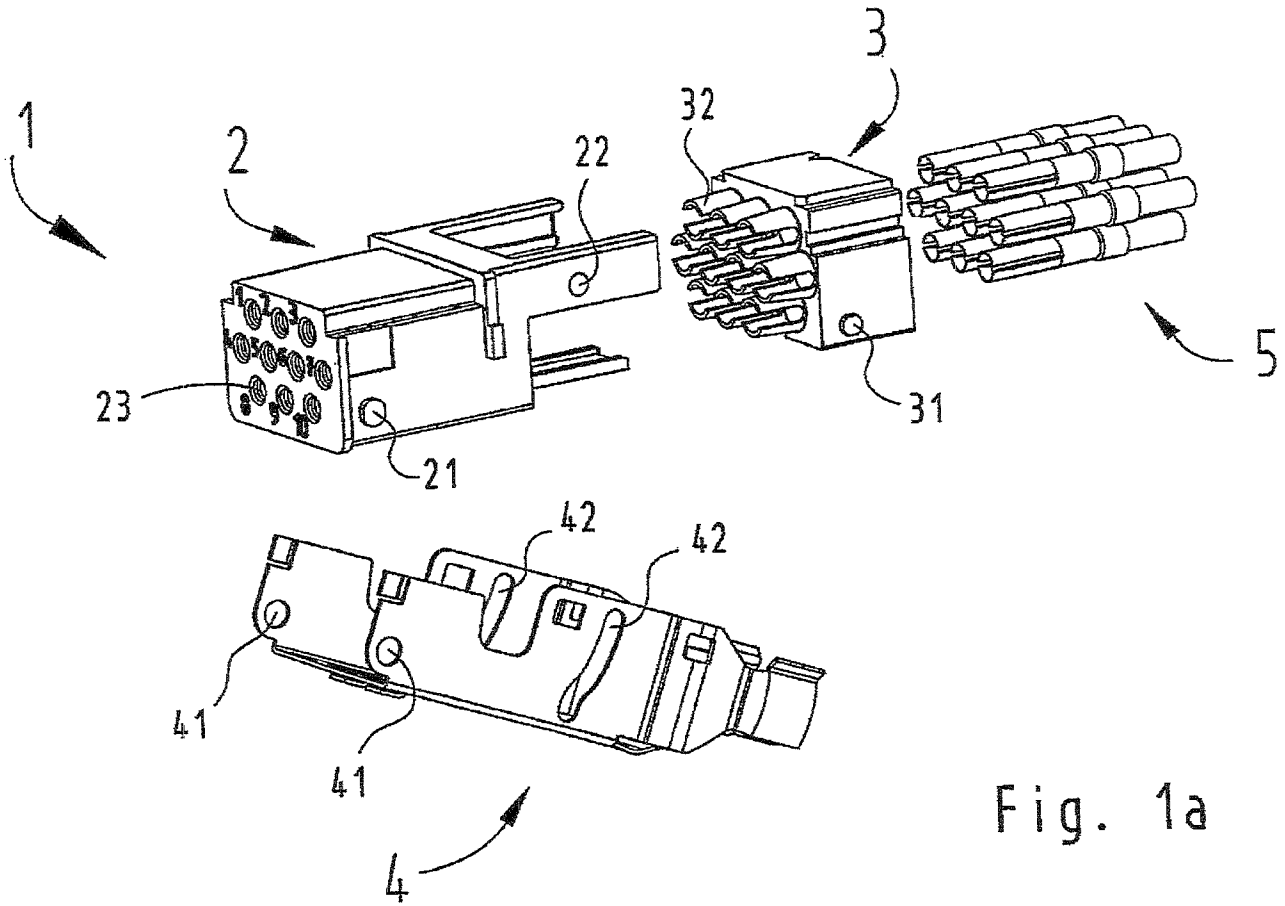

(51) Int. Cl.

| | |
|---|---|
| ***H01R 13/514*** | (2006.01) |
| ***H01R 13/6581*** | (2011.01) |
| *H01R 13/516* | (2006.01) |
| *H01R 13/6592* | (2011.01) |

(56) References Cited

U.S. PATENT DOCUMENTS

| | | | | |
|---|---|---|---|---|
| 5,308,255 | A * | 5/1994 | Yamanashi | H01R 13/62955 439/157 |
| 5,409,400 | A | 4/1995 | Davis | |
| 5,551,885 | A * | 9/1996 | Yamanashi | H01R 13/62933 439/157 |
| 5,603,624 | A * | 2/1997 | Taguchi | H01R 13/62933 439/157 |
| 5,733,146 | A | 3/1998 | Block | 439/610 |
| 5,957,720 | A * | 9/1999 | Boudin | H01R 24/64 439/409 |
| 6,273,756 | B1 * | 8/2001 | Ward | H01R 13/6596 439/372 |
| 6,739,888 | B2 * | 5/2004 | Kato | B60L 3/00 439/157 |
| 7,008,255 | B1 * | 3/2006 | Wang | H01R 13/506 439/357 |
| 7,413,464 | B1 * | 8/2008 | Chen | H01R 4/2433 439/404 |
| 7,811,105 | B1 * | 10/2010 | Tan Chin Yaw | H01R 13/6335 439/157 |
| 7,967,642 | B2 * | 6/2011 | Schoene | H01R 4/2433 439/660 |
| 8,357,016 | B2 | 1/2013 | Schumacher et al. | 439/814 |
| 2010/0046293 | A1 | 2/2010 | Won | |

FOREIGN PATENT DOCUMENTS

| | | | |
|---|---|---|---|
| EP | 0 800 238 | 10/1997 | H01R 13/658 |
| EP | 1 310 019 | 11/2006 | H01R 4/24 |
| KR | 1020090066033 A | 6/2009 | |
| WO | WO 2010/046293 | 4/2010 | H01R 13/436 |

OTHER PUBLICATIONS

International Search Report issued in corresponding PCT Patent Appln. Serial No. PCT/DE2012/100273 dated Dec. 4, 2012, with English translation (4 pgs).

* cited by examiner

PLUG-IN CONNECTOR

The invention relates to a plug-in connector, comprising an insulating body, a contact support, a shielding device and a plurality of contacts designed to be disposed in the contact support, wherein the shielding device is pivotably retained on the insulating body.

Such a plug-in connector is used for example in the area of industry as well as in telecommunications.

PRIOR ART

Document WO2010046293A1 describes a plug-in connection wherein contacts can be pre-mounted in a contact support and the contact support can be moved on a contact holder into a final mounting position. It is further disclosed that the contact support may be latchable in at least two positions on the contact holder, which are axially offset from each other in the plug-in direction, and that two pivotable shielding plates are provided on the plug housing and/or the socket housing, which shielding plates can be pivoted on the plug housing from a position in which they open out at an angle into a position in which they are closed.

A drawback of such a plug-in connector consists in that it is made from a plurality of parts, as a result of which they are relatively complex to handle during assembly.

OBJECT

The present invention is therefore based on the object of providing a plug-in connector having a comparatively low mounting complexity.

This object is achieved by means of the fact that the shielding device has first guiding means in operative connection with second guiding means of the contact support, so that the contact support can be inserted into the insulating body by way of a pivoting movement of the shielding device or can be attached to the insulating body.

Advantageous embodiments of the invention are indicated in the dependent claims.

The invention relates to a plug-in connector which, although it is made up of multiple parts, can be delivered to a user in one piece, i.e. in the form of assembled individual parts. Once contacts, e.g. socket or pin contacts, have been manually inserted into the contact support, the shielding device can be pivoted over the insulating body in a single movement, as a result of which the contact support can be inserted into the insulating body or can be attached to the insulating body, so that the contacts can be fixed in their final position in the plug-in connector, the shielding device may be latched on the insulating body or on the contact support, and as a result, the contact support may be fixed in or on the insulating body.

This is particularly advantageous because it reduces the assembly complexity. The associated individual parts are already available to the user in a pre-mounted form and are therefore pre-sorted in the form in which they belong together and no longer need to be laboriously put together and assembled by the user.

In particular, all the user needs to do for the assembly is to insert the contacts connected to cables, for example crimped, into the contact support and to push the shielding device down, i.e. to pivot it over the insulating body, in order to mount the plug-in connector on the side of the cable connection, which constitutes a substantial reduction of the assembly complexity compared to the prior art.

Further, disassembly is also simplified. By pivoting the shielding device back, the latter is unlatched, the fixing of the contact support on the insulating body is released and the contact support is automatically pulled out of the insulating body as a result of said operative connection. As a result, the fixing of the contacts is released as well, so that these can be removed again.

Further, it is particularly advantageous if the insulating body has at least two preferably circular holes or recesses and the shielding device has at least two pivot pins which engage in the holes or recesses of the insulating body, because this ensures that the shielding device can be pivoted about the pivot pins.

In a further advantageous embodiment, the insulating body has at least two pivot pins and the shielding device has at least two circular holes or indentations which engage around the pivot pins of the insulating body, so that the shielding device can be pivoted about the pivot pins. As a result, such an arrangement can moreover be manufactured with little effort.

It is further advantageous if the insulating body has at least two hinge windows and the shielding device has at least two hinge tabs which engage in the hinge windows of the insulating body, so that the shielding device is pivotably retained on the insulating body.

It is particularly advantageous if the first guiding means of the shielding device consists of at least one guide slot or at least one guide groove and the second guiding means of the contact support consists of at least one guide pin that engages in the guide slot or in the guide groove of the shielding device, and during the pivoting movement of the shielding device, the guide pin is guided along the guide slot or the guide groove, and due to the shape of this guide slot or guide groove, the guide pin is moved in the direction of the insulating body and the contact support is inserted into the insulating body or is attached to the insulating body, because such an arrangement can be manufactured with little effort and functions in a stable manner.

In an advantageous embodiment the shielding device, which consists in particular of a zinc die casting component, has a plurality of, preferably two, retention noses which advantageously prevent the contact support from being pushed out of the insulating body. The retention noses may advantageously be designed to be spring-loaded, in order to push the contact support and/or the insulating body into a fixed seating position via corresponding latching contours, for example via interlocking pockets, and to fix them there.

In a preferred embodiment, the shielding device can be latched onto the insulating body and/or the contact support. In particular, the insulating body and/or the contact support may include a latch nose, onto which the shielding device latches, preferably with a first end of its guide slot or its guide groove or with an opening specifically provided for this purpose. This has the advantage that the contact support inserted into the insulating body or attached to the insulating body is fixed in or on the insulating body.

It is particularly advantageous if the contacts can be fixed in their final positions by inserting, in particular pushing in, the contact support into the insulating body or by attaching the contact support to the insulating body. Such an embodiment will be described below. In this case, the insulating body has first through-bores. The contact support has second through-bores for receiving the contacts, e.g. the pin or socket contacts. At one end of the second through-bores, the contact support has lamellae comprising the received contacts. The first through-bores of the insulating body respectively have, preferably adjacent to the contact support, a funnel-shaped region. When inserting or attaching the contact support equipped with contacts in or on the insulating body, the contacts are at least partially inserted into the first through-bores thereof, and in the course of this, the lamellae of the contact supports are pressed together by the funnel-shaped regions. As a result, the contacts are fixed in their final position in the plug-in connector.

The insulating body may preferably have special recesses in the funnel-shaped region of its first through-bores, and the lamellae may have matching ring-shaped portions moulded on, which engage in the special recesses and which are pressed together as a result of the insertion of the contact support into the insulating body and effect or at least support thereby the pressing together of the lamellae and thus the final fixing of the contacts in the plug-in connector.

EMBODIMENT EXAMPLE

Figure 1B:
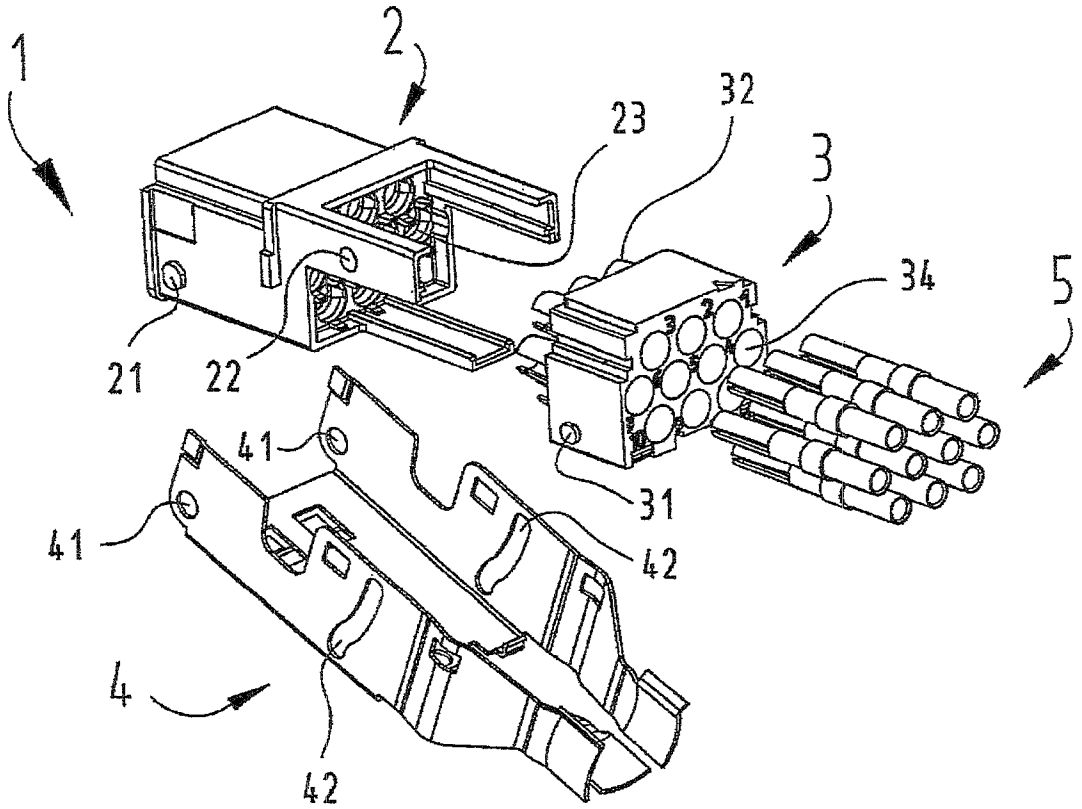
Figure 2A:
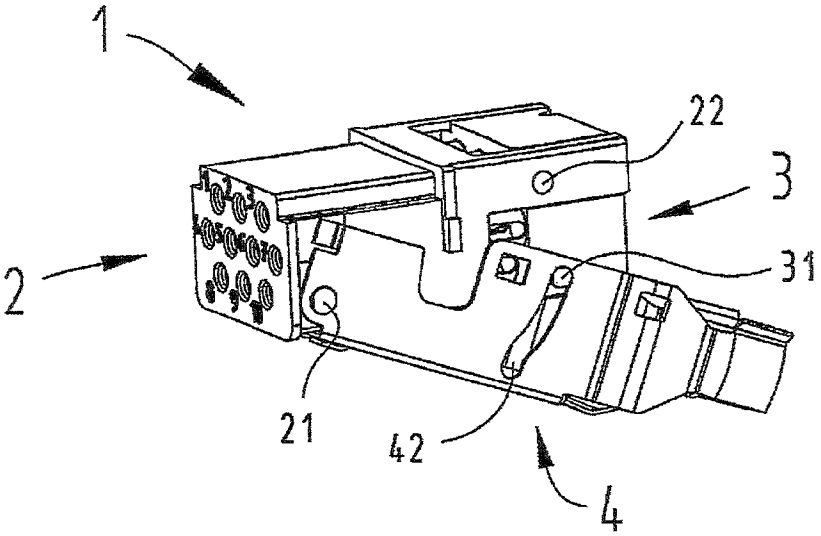
Figure 2B:
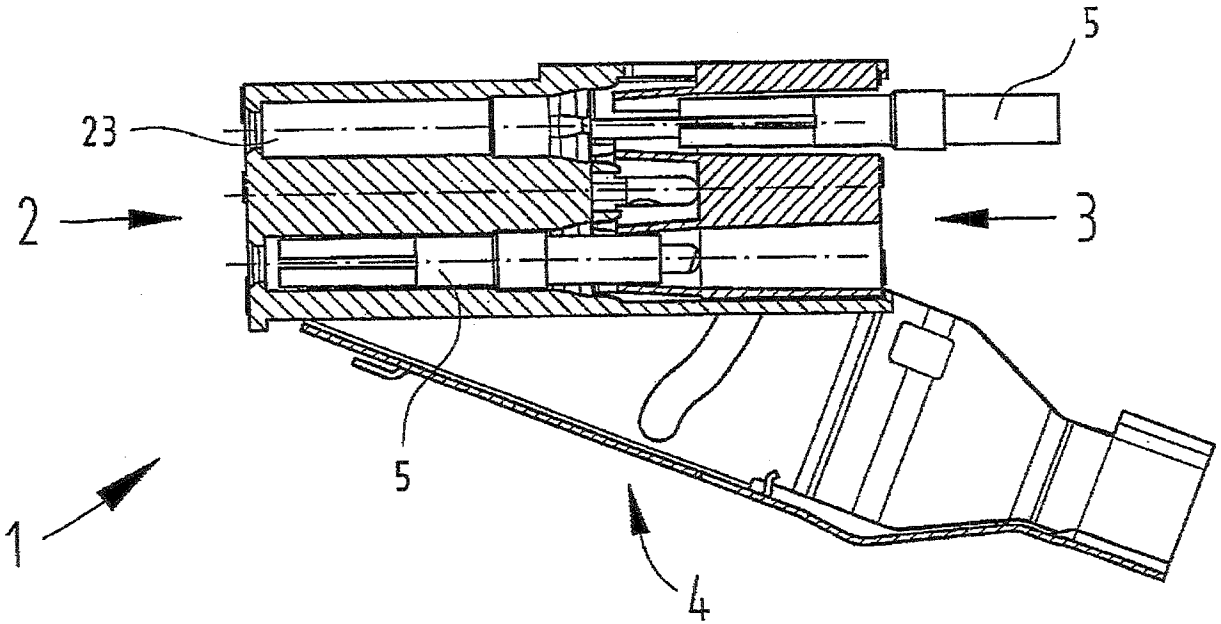
Figure 3A:
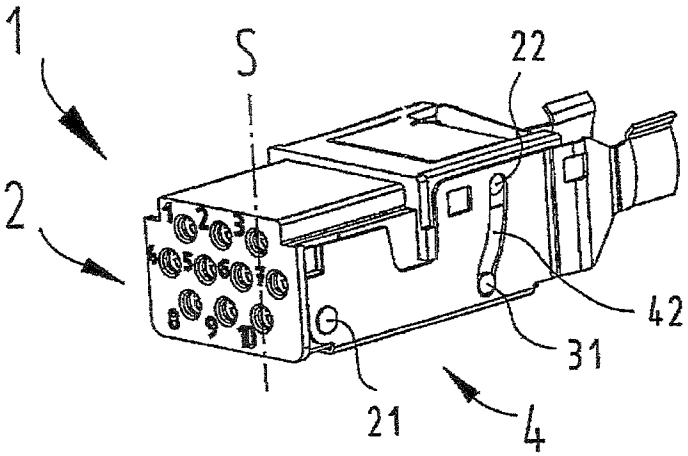
Figure 3B:
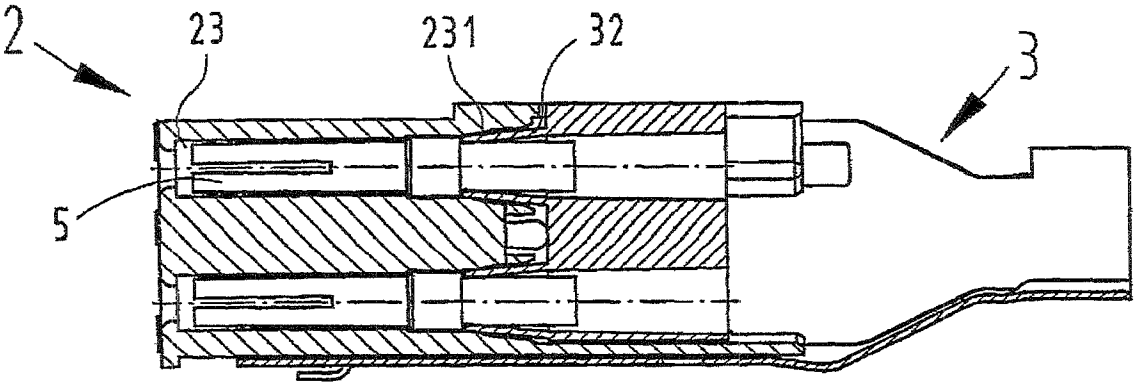
Figure 3C:
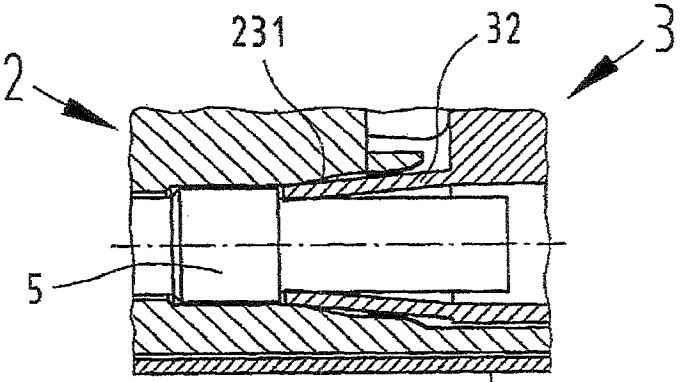
Figure 4:
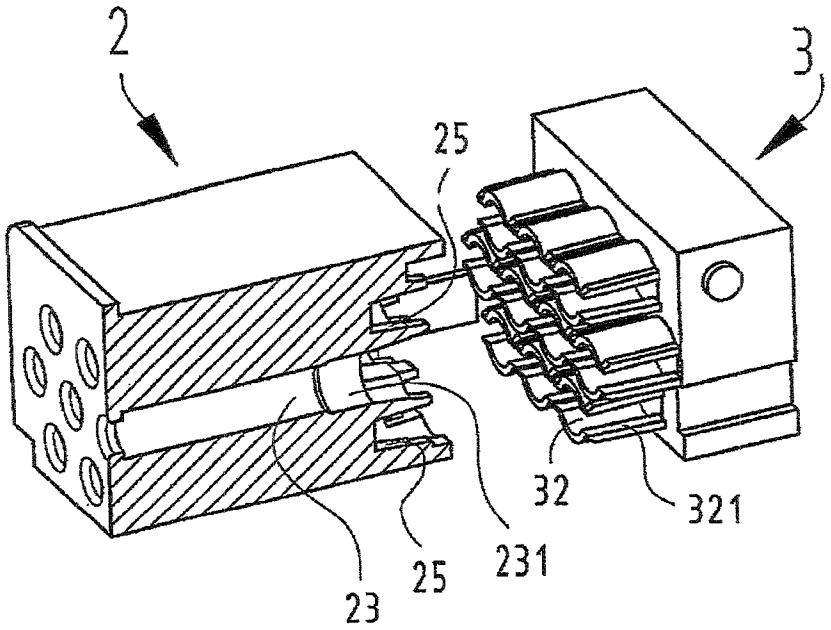
Figures 5A, 5B:
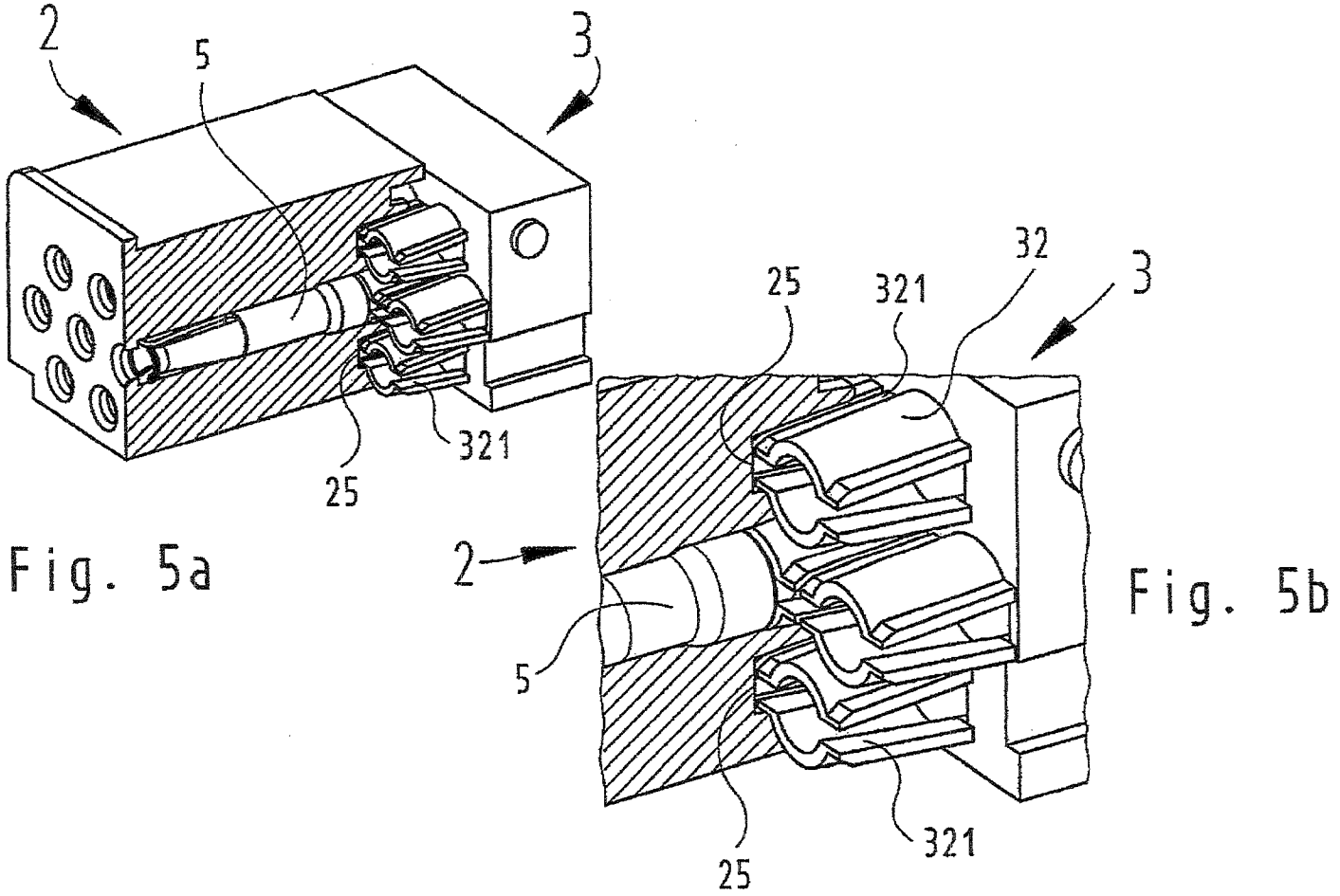
Figure 6:
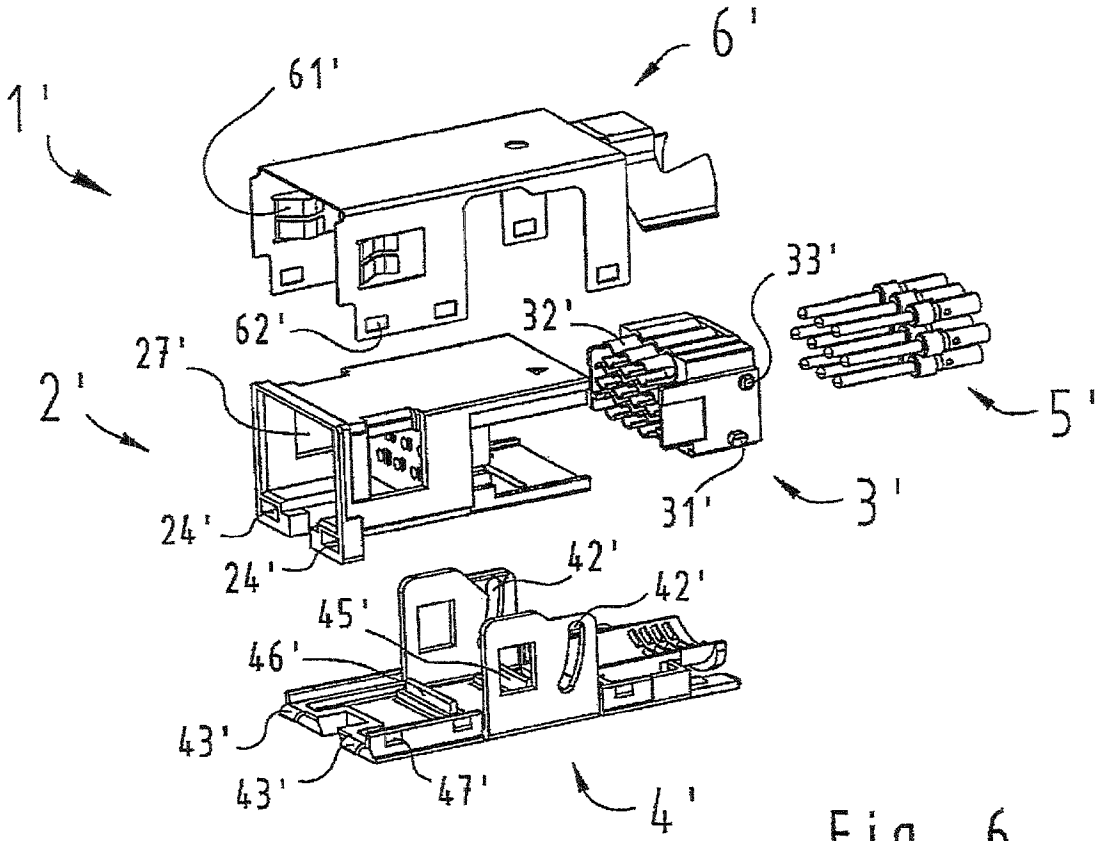
Figure 7A:
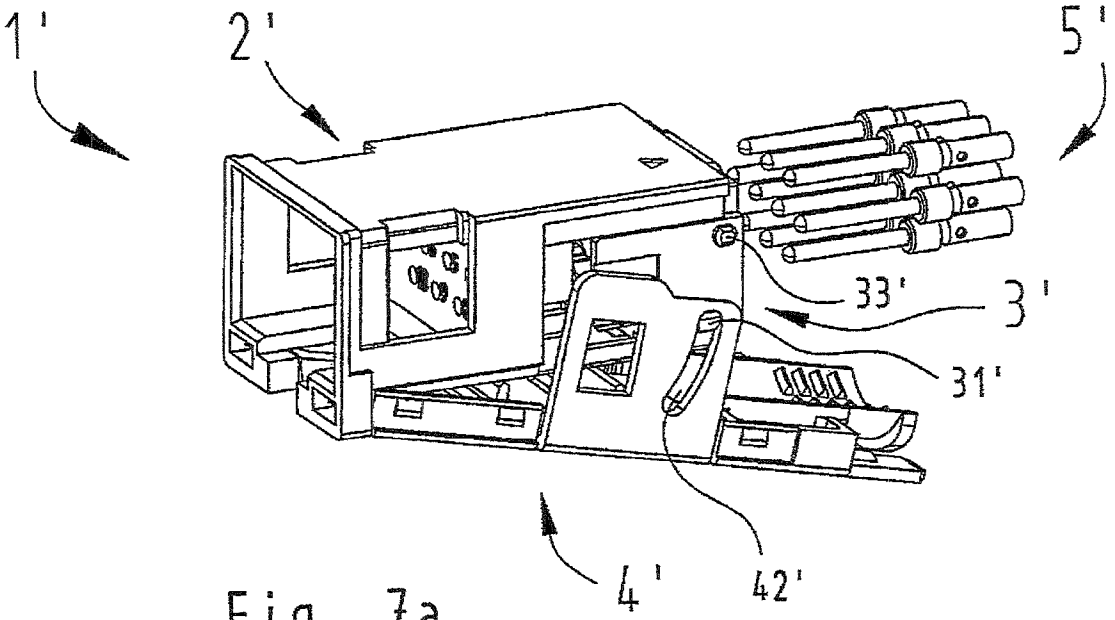
Figure 7B:
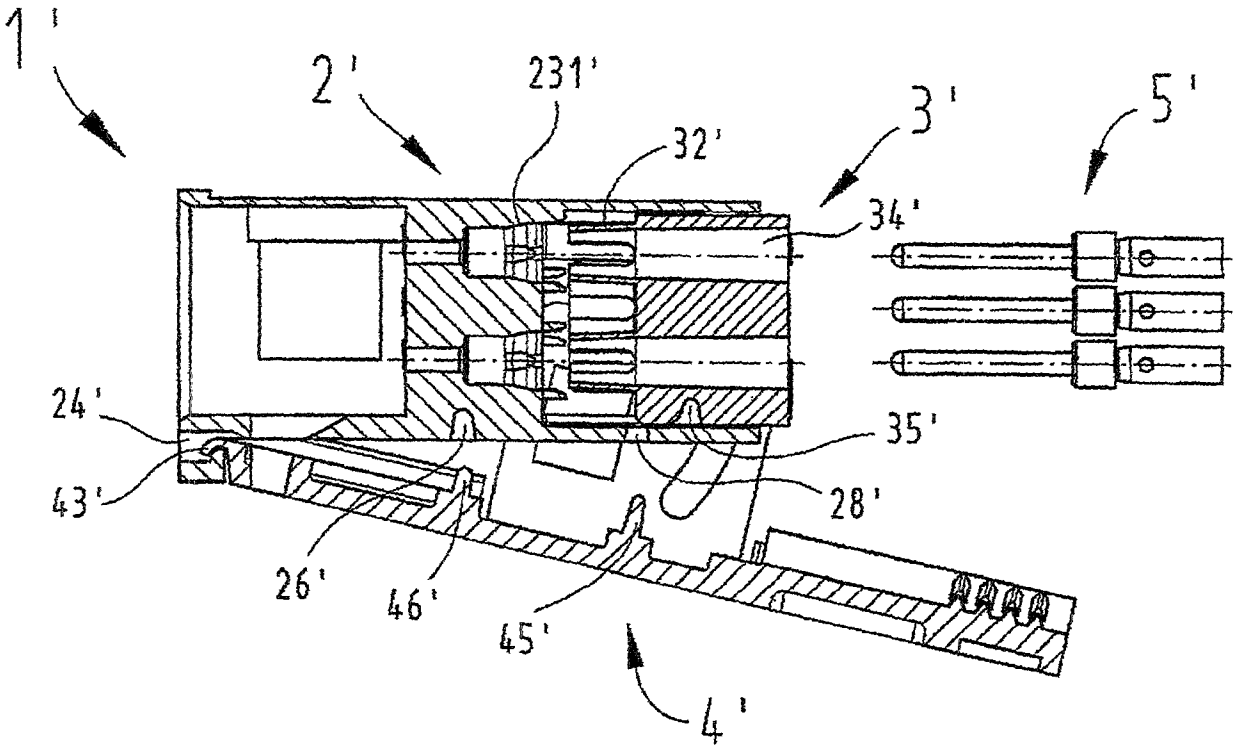
Figure 7C:
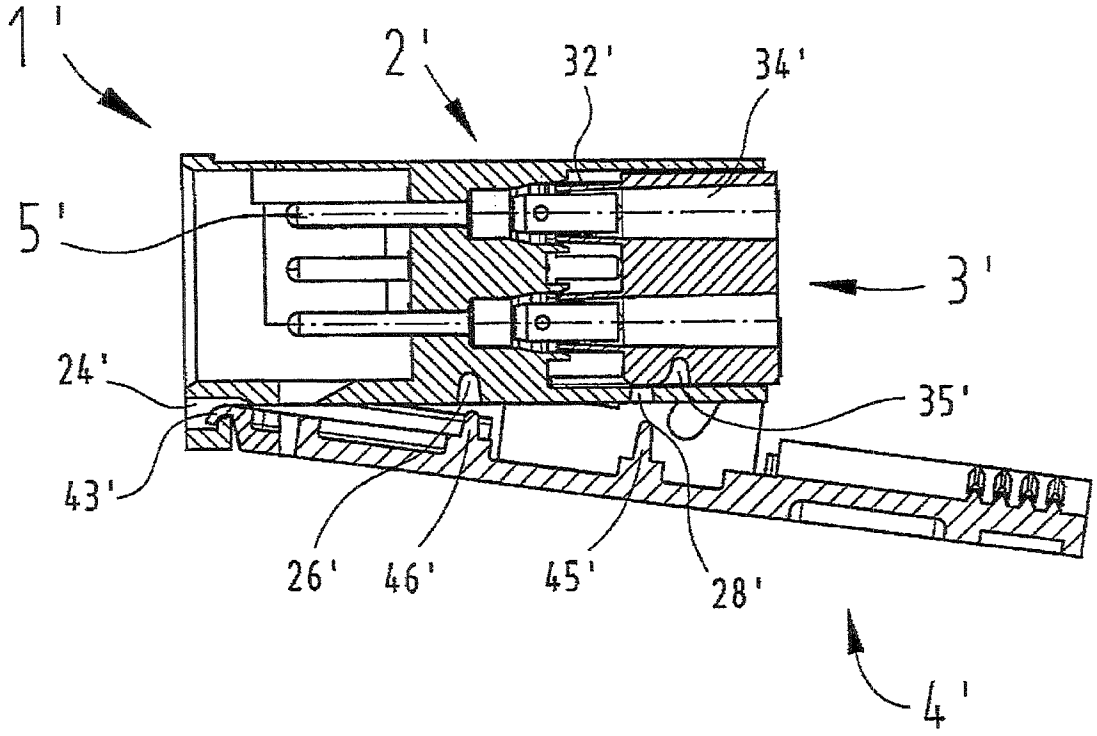
Figure 7D:
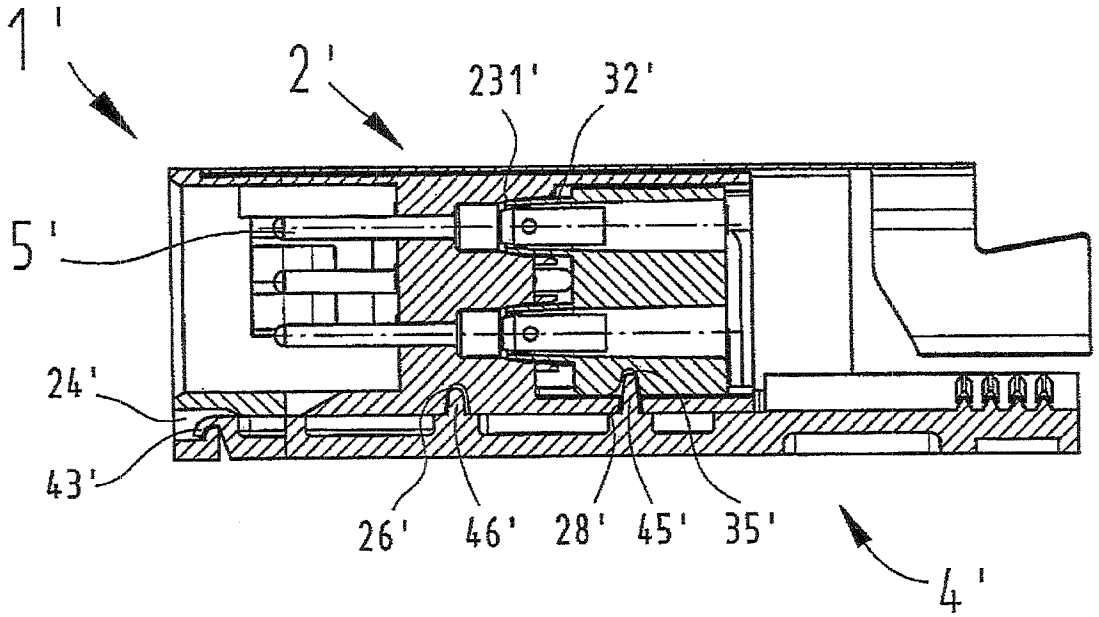

Two embodiment examples of the invention will be illustrated in the drawing and will be explained in more detail below, wherein:

FIG. 1*a* shows an exploded view of a plug-in connector with socket contacts;

FIG. 1*b* shows the exploded view of the plug-in connector from a different perspective;

FIG. 2*a* shows a perspective view of the assembled plug-in connector with a contact support that has not yet been inserted;

FIG. 2*b* shows a sectional view of the assembled plug-in connector with the contact support not yet pushed in and a socket contact that has not yet been completely inserted;

FIG. 3*a* shows a perspective view of the plug-in connector in the locked condition;

FIG. 3*b* shows a sectional view of the insulating body with the pushed-in contact support with two contacts;

FIG. 3*c* shows an enlarged cutout from the above-mentioned sectional view;

FIG. 4 shows a three-dimensional view of the cut-away plug-in connector with the contact support to be inserted;

FIG. 5*a* shows a three-dimensional view of the cut-away plug-in connector with the inserted contact support and an exemplary fixed socket contact;

FIG. 5*b* shows an enlarged cut-out from the above-mentioned view;

FIG. 6 shows an exploded view of a further plug-in connector with pin contacts;

FIG. 7*a* shows a perspective view of this assembled plug-in connector with pin contacts to be inserted;

FIG. 7*b* shows a sectional view of the assembled plug-in connector with pin contacts yet to be inserted;

FIG. 7*c* shows a sectional view of the assembled plug-in connector with inserted pin contacts;

FIG. 7*d* shows a sectional view of the plug-in connector in the locked condition.

FIRST EMBODIMENT EXAMPLE

FIGS. 1*a* and 1*b* respectively show an exploded view of a plug-in connector 1 from different perspectives. The plug-in connector 1 comprises an insulating body 2, a contact support 3 and a shielding device 4 as well as a plurality of contacts which are implemented as socket contacts 5.

The insulating body 2 has two pivot pins 21 and two latch pins 22, of which respectively just one is shown in the drawing, because the other one is moulded symmetrically thereto on the opposite side of the insulating body 2 and is therefore, in the perspective shown, covered by the insulating body 2. Further, the insulating body 2 has a plurality of first through-bores 23.

The contact support 3 has two guide pins 31, of which again only one is shown in the drawing, because the other one is moulded symmetrically thereto on the opposite side of the contact support 3 and is therefore, in the perspective shown, covered by the contact support 3. In FIG. 1*b*, second through-bores 34 passing through the contact support 3 can be seen, which are provided for receiving the socket contacts 5. On that side of the contact support 3 that is designed for being inserted into the insulating body 2, lamellae 32 are moulded onto these second through-bores 34, which lamellae can be seen particularly well in FIG. 1*a*.

The shielding device 4 is a punch-bent part, preferably made from sheet metal. The shielding device 4 has two circular holes 41 as well as two guide slots 42.

FIG. 2*a* shows a plug-in connector 1 assembled from a plurality of individual pieces, namely the insulating body 2, the contact support 3 and the shielding device 4, wherein the contact support 3 has not yet been pushed into the insulating body 2. The guide pin 31 is located at a first end of the guide slot 42. It can be seen in this illustration that a pivoting movement of the shielding device 4 about a rotary axis extending through the pivot pins 21 will automatically, guided by the guide pin 31 in the guide slot 42 with subsequent latching of the first end of the guide slot 42 on the latch pin 22, push the contact support 3 into the insulating body 2 and retain it there.

FIG. 2*b* shows a sectional view of this arrangement together with two socket contacts 5, namely a socket contact 5 that has already been inserted as well as one that is yet to be inserted. The section is made through a sectional axis S which is shown in FIG. 3*a* on the insulating body 2 of the locked plug-in connector 1.

In FIG. 3*a*, the shielding device 4 is latched onto the first end of the guide slot 42 on the latch pin 22 of the insulating body 2, and the guide pin 31 is located on a second end of the guide slot 42. To this end, the shielding device 42 is first pivoted in a pivoting movement about the rotary pin 21 over the insulating body 2. During this pivoting movement, the guide pin 31 is guided from the first end of the guide slot 42 along the guide slot 42 to the second end of the guide slot 42, and as a result of this the contact support 3 is inserted into the insulating body 2.

It can further be seen from this view that a pivoting back of the shielding device 4 in the opposite direction, i.e. from the position shown in FIG. 3*a* into the position shown in FIGS. 2*a* and 2*b*, results in a pulling out of the contact support 3 from the insulating body 2, whilst the guide pin 31 is guided from the second end of the guide slot 42 along the guide slot 42 to the first end of the guide slot 42.

FIG. 3*b* shows a section through the insulating body 2 with the contact support 3 pushed in. Here, the contact support 3 is provided with the socket contacts 5. It is further shown that the first through-bore 23 has, adjacent to the contact support 3, a funnel-shaped region 231 that is engaged by the corresponding lamellae 32 of the contact support 3.

This funnel-shaped region 231 is shown in an enlarged view in FIG. 3*c*. It can be seen there particularly well that the lamellae 32 are pressed together by the funnel-shaped region 231 during the insertion of the contact support 3 into the insulating body 2 and as a result fix the contact sockets 5 in their final position in the contact support 3 and in the insulating body 2 and thus also in the entire plug-in connector 1.

FIG. 4 shows a cut-out of the sectioned insulating body 2 with the contact support 3 to be inserted without the socket contacts 5. The funnel-shaped region 231 of the first through-bores 23 can be seen particularly well in this view. It can further be seen that the lamellae 32 have moulded thereto lateral wing-shaped parts 321 and that the insulating body 2 has special recesses 25 on its funnel-shaped regions 231. These special recesses 25 are engaged by the wing-shaped moulded-on parts 321 of the lamellae 32. In particular, due to the wing-shaped moulded-on parts 321, the lamellae 32 are pressed together by the special recesses 25 of the funnel-shaped region 231 during the assembly of the contact support 3 with the insulating body 2.

FIG. 5*a* shows the insulating body 2 with the contact support 3 attached thereto and an exemplary inserted socket contact 5. FIG. 5*b* shows a corresponding enlarged view. On those lamellae 32 into which, for reasons of clarity, no socket contacts 5 have been inserted, the interaction of the wing-shaped moulded-on parts 321 with the special recesses 25 can be seen particularly well. By pushing the contact support 3 into the insulating body 2, the illustrated part of the contact support 3 is attached to the illustrated part of the insulating body 2 and the lamellae 32 are pressed together due to their wing-shaped moulded-on parts 321 by the funnel-shaped region 231 of the first through-bore 23 and by the special recesses 25 of the insulating body 2 and fix thereby the socket contacts 5, which may be located therein, in their final position in the plug-in connector 1.

Thus, an insertion of the contact support 3 into the insulating body 2, a final fixing of the contacts, in particular of the socket contacts 5, in the plug-in connector 1, a latching of the shielding device 4 and a retention of the contact support 3 in the plug-in connector 1, are ultimately achieved by just one single movement, namely the pivoting of the shielding device 4.

SECOND EMBODIMENT EXAMPLE

FIG. 6 shows a further plug-in connector 1'.

This plug-in connector 1' comprises an insulating body 2', a contact support 3', a shielding device 4', a plurality of contacts implemented as pin contacts 5', as well as a shielding hood 6', preferably made from metal sheet.

The shielding device 4' is preferably made using a zinc die casting process. As an alternative, the shielding device 4' could also be made from plastics with a shielding coating or from a plastics material without a shielding coating. In the latter case, however, the shielding device 4' would not have any electrical shielding properties.

On one end, the shielding device 4' has two bent hinge tabs 43' as well as two guide slots 42'. The contact support 3' has two guide pins 31' and two latch pins 33', of which respectively only one can be seen in the drawing, because the respectively other one is covered by the contact support 3'.

The insulating body 2' has on one end two hinge windows 24' as well as respectively one shielding window 27' on two sides lying opposite each other. The shielding hood 6' has two contact springs 61' on each side. Further, the shielding hood 6' has a plurality of latch windows 62'. The shielding device 4' also has matching latch noses 47'. As a result, the shielding hood 6' is suitable for being pushed over the otherwise fully assembled plug-in connector 1' and to be fixed there, in order to improve the shielding. As a result of the contact springs 61', which in the assembled condition engage through the shielding window 27' of the insulating body 2', a mating plug, for example the plug-in connector 1 described in the first embodiment example, can be contacted with its shielding device 4 in the plugged-in condition, in order to provide in this way a ground contact between the two shielding devices 4, 4' of the two plug-in connectors 1, 1'.

Further, the shielding device 4' of this plug-in connector 1' has two retention noses 45', 46'.

In FIG. 7*a*, this plug-in connector 1' has been largely assembled, but the contact support 3' has not yet been pushed into its final position and the pin contacts 5' have not yet been inserted into the contact support 3'. In this view or below, the shielding hood 6' has not been shown for reasons of clarity.

The guide pin 31' is located within the guide slot 42', namely on a first end of this guide slot 42'.

It can easily be seen that by pivoting the shielding device 4', the contact support 3' can be inserted into the insulating body 2' by passing, during the pivoting of the shielding device 4, the guide pin 31' from the first end of the guide slot 42' along the guide slot 42 to a second end of the guide slot 42. After the pivoting operation, the first end of the guide slot 42' can be latched onto the latch pin 33' of the contact support 3' and can retain in this way the contact support in the insulating body.

FIG. 7*b* shows the same arrangement in a sectional view. The hinge tabs 43' engage in the hinge windows 24', so that the shielding device 4' can be pivoted about an axis extending through the hinge windows 24'. In this view, the first retention nose 46' and the second retention nose 45' of the shielding device 4' can be seen particularly well. The first retention nose 46' is intended for engaging in a correspondingly shaped first pocket 26' of the insulating body 2'. The second retention nose 45' is intended for engaging through a corresponding retention opening 28' of the insulating body 2' into a second pocket 35' of the contact support 3', once the contact support 3' has been pushed into its final position in the insulating body 2'. Further, this view shows the shape of the first through-bores 23', which have a funnel-shaped region 231' at the end, which is directed towards the contact support 3'. It can be seen from this view that the lamellae 32' are pressed together by the funnel-shaped region 231' of the first through-bore 23' as a result of the pushing of the contact support 3' into the insulating body 2'.

FIG. 7*c* shows the same arrangement in a sectional view, however, the pin contacts 5' have here already been pushed into the contact support 3'. In this view, too, the contact support 3' has not yet been pushed into its final position in the insulating body 2'. However, it can be seen that in the final position, the second pocket 35' of the contact support 3' comes to lie over a retention opening 28' of the insulating body 2'. It can further be seen that by pressing the lamellae 32' together when pushing the contact support 3' into the insulating body 2', the pin contacts 5' are fixed in the contact support 3', which is fixed in the course of this, and thus also in its final position in the plug-in connector 1'.

FIG. 7*d* shows the same arrangement with the shielding device 4' pivoted over the insulating body 2'. Correspondingly, the contact support 3' has been inserted into its final position in the insulating body 2'. In the course of this, the lamellae 32' were pressed together by the funnel-shaped region 231' and fix the pin contacts 5' in their final position in the plug-in connector 1'. The retention noses 46' and 45' engage in the pockets 26' and 35' of the insulating body 2' and of the contact support 3', respectively, and the second retention nose 45' engages through the retention opening 28' of the insulating body 2'.

LIST OF REFERENCE NUMERALS

1, 1' Plug-in connector
2,2' Insulating body
21 Rotary pin
22 Latch pin of the insulating body
23,23' First through-bores
231,231' Funnel-shaped region of the first through-bores
24' Hinge window
25 Special recesses
26' First pocket of the insulating body
27' Shielding window
28' Retention opening
3,3' Contact support
31,31' Guide pin
32,32' Lamellae
321 Wing-shaped moulded-on parts of the lamellae
33' Latch pin of the contact support
34,34' Second through-bores
35' Second pocket of the contact support
4,4' Shielding device
41 Circular holes
42,42' Guide slot
43' Hinge tabs
45',46' Retention noses
47' Latch noses
5,5' Contacts (socket, pin contacts)
6' Shielding hood
61' Contact springs
62' Latch window

The invention claimed is:

1. A plug-in connector, comprising an insulating body, a contact support, a shielding device and a plurality of contacts, designed to be arranged in said contact support, wherein said shielding device is pivotably retained on said insulating body, wherein said shielding device includes a first guide in operative connection with a second guide of said contact support, so that the contact support can be inserted into said insulating body or attached to said insulating body by a pivoting movement of said shielding device, and wherein said shielding device is made from a metal sheet or a zinc die casting component or plastic with a shielding coating for use with telecommunications equipment in order to reduce radio frequency interference and electromagnetic interference.

2. The plug-in connector as claimed in claim 1, wherein said insulating body has at least two rotary pins and in that said shielding device has at least two holes or indentations which engage around the rotary pins of said insulating body, so that said shielding device can be pivoted about said rotary pins.

3. The plug-in connector as claimed in claim 1, wherein said insulating body has at least two hinge windows and that said shielding device has at least two hinge tabs which engage in said hinge windows of said insulating body, so that said shielding device is pivotably retained on said insulating body.

4. The plug-in connector as claimed in claim 1, wherein the first guide of said shielding device comprises at least one guide slot or at least one guide groove, and that the second guide of said contact support comprises at least one guide pin that engages in said guide slot or in said guide groove of said shielding device.

5. The plug-in connector as claimed in claim 1, wherein the contacts can be fixed in a final position in said plug-in connector by inserting said contact support into said insulating body or by attaching said contact support onto said insulating body.

6. The plug-in connector as claimed in claim 1, wherein said insulating body has first through-bores and that said contact support has second through-bores for receiving said contacts, and in that the said contact support has on one end of said second through-bores lamellae designed to engage a received contact circumferentially around said received contact.

7. The plug-in connector as claimed in claim 1, wherein said insulating body has first through-bores and said first through-bores have respectively one funnel-shaped region.

8. The plug-in connector as claimed in claim 6, wherein said first through-bores of said insulating body have respectively one funnel-shaped region.

9. The plug-in connector as claimed in claim 8, wherein said lamellae of said contact support and the funnel-shaped regions of said first through-bores of said insulating body are suitable for cooperating in order to fix said contacts in a final position in said plug-in connector.

10. The plug-in connector as claimed in claim 1, wherein said shielding device can be latched onto said insulating body or onto said contact support.

11. The plug-in connector as claimed in claim 10, wherein said insulating body or said contact support has at least one latch pin, on which said shielding device is latched, preferably with one end of a guide slot or a guide groove thereof.

12. The plug-in connector as claimed in claim 10, wherein said insulating body or said contact support has two latch pins, on which said shielding device is latched, preferably with one end of a guide slot or a guide groove thereof.

13. The plug-in connector as claimed in claim 11, wherein by latching said shielding device onto said insulating body, said contact support can be fixed in or on said insulating body.

14. The plug-in connector as claimed in claim 12, wherein by latching said shielding device onto said insulating body, said contact support can be fixed in or on said insulating body.

* * * * *